US007597223B1

(12) United States Patent
Martinez

(10) Patent No.: US 7,597,223 B1
(45) Date of Patent: Oct. 6, 2009

(54) HOLDER FOR NON-FOLDING TOOL

(76) Inventor: Michael A. Martinez, P.O. Box 4923, Albuquerque, NM (US) 87196

( * ) Notice: Subject to any disclaimer, the term of this patent is extended or adjusted under 35 U.S.C. 154(b) by 711 days.

(21) Appl. No.: 10/980,385

(22) Filed: Nov. 3, 2004

Related U.S. Application Data

(63) Continuation-in-part of application No. 10/327,720, filed on Nov. 20, 2002, now Pat. No. 6,817,499.

(51) Int. Cl.
*A45F 5/00* (2006.01)

(52) U.S. Cl. ..... 224/197; 224/232; 224/667; 224/269

(58) Field of Classification Search ..... 224/197, 224/232, 233, 200, 660, 661, 666–668, 671, 224/676–679, 237, 240, 242, 245
See application file for complete search history.

(56) References Cited

U.S. PATENT DOCUMENTS 2,310,204 A * 2/1943 Beckwith et al. ..... 224/232
3,191,825 A * 6/1965 Beckwith ..... 224/232
3,992,776 A * 11/1976 Koppe et al. ..... 224/232
4,524,892 A * 6/1985 Ozeki ..... 224/256
4,759,483 A * 7/1988 Willoughby ..... 224/672
4,781,315 A * 11/1988 Nordskog ..... 224/165
4,805,819 A * 2/1989 Collins ..... 224/232
5,031,810 A * 7/1991 Finn et al. ..... 224/581
5,115,953 A * 5/1992 Werner ..... 224/232
5,647,130 A * 7/1997 Collins ..... 30/151
5,699,943 A * 12/1997 Schaefer et al. ..... 224/197
5,878,500 A * 3/1999 Emerson ..... 30/158
5,915,793 A * 6/1999 Serpa ..... 30/162

* cited by examiner

*Primary Examiner*—Nathan J Newhouse
*Assistant Examiner*—Corey N Skurdal
(74) *Attorney, Agent, or Firm*—Yorgos Marinakis

(57) ABSTRACT

The specification and drawing figures describe and show holder for a non-folding tool that includes a first case formed with a duct. The first case is connected to a deployment control unit detachably that is removably insertable in the first case. At least one second case is included that is formed with a cavity. A plurality of second cases are provided to accommodate varying dimensions of the non-folding tool. The second case is removably connectable to the first case. A tension membrane, slidably insertable into the first case, is provided for controlling movement of the tool within the holder. A variably positionable mounting assembly engageable with the holder and with a user is provided. This abstract is provided to comply with rules requiring an abstract that will allow a searcher or other reader to quickly ascertain the subject matter of the technical disclosure, but this abstract is not to be used to interpret or limit the scope or meaning of any claim.

18 Claims, 18 Drawing Sheets

HOLDER FOR NON-FOLDING TOOL

CROSS-REFERENCE TO RELATED APPLICATION

This application is a continuation-in-part from a continuation-in-part application Ser. No. 10/327,720 entitled Holder for a Folding Tool, filed on Nov. 20, 2002, now U.S. Pat. No. 6,817,499 for which the U.S. Patent Office has issued a notice of allowability to the same sole inventor named in this application.

FIELD OF TECHNOLOGY

The field of technology pertains generally to a holder for a non-folding tool. More particularly, the holder for a non-folding tool disclosed and claimed in this document includes a variably positionable sheath allowing safe, rapid, and silent deployment of a fixed-blade knife from, and insertion into, a sheath using only one hand.

BACKGROUND

Beginning in the 18$^{th}$ century, technological advancements in forging metals that could hold sharp edges when formed into knife blades inaugurated significant alteration of the design, manufacture, and use of knives. What had been primitive tools started to become diverse, formidable, and even elegant implements. In recent decades, advancements in knife manufacturing technology have accelerated. Numerous companies and individuals now are devoted exclusively to design and manufacture of a wide variety of knives for work, sport, and collecting.

In the 21$^{st}$ century, many blades are manufactured from stainless steel, particularly martensitic stainless steels. Most blades include a wide variety of chromium that imparts corrosion resistance, and carbon, that provides hardening of a knife blade by heat treatment. Edge retention of knife blades has increased with the formulation of higher carbon content; corrosion resistance has increased by the use of higher chromium content.

The degree to which knife blades are treated for edge retention, corrosion resistance, and hardening depends at least in part on the uses for a particular knife. Modern knives have a variety of distinctive uses. The blade of a knife is the major determining factor in the work to which a knife and knife blade may be applied. The blade also is the chief concern in connection with safety in using a knife. Cost of a knife is a function, then, of the quality of the blade steel, workmanship, material used in forming a handle for the knife, and ornamentation. A knife blade generally is forged from steel into a desired shape, hardened and tempered, ground to a cutting edge, polished to remove all traces of forging and heat treatment, and fitted to a handle. A wide variety of materials is used for handles, including horns and tusks, various woods, bone, and now an array of synthetic materials.

A major threshold factor, in the choice of a knife is between a fixed-blade or a folding knife. Folding knives, also called "folders," usually are selected on the basis of the intended use and user preference. An exemplary holder for a folding tool, including a folding knife, is disclosed and claimed in pending U.S. patent application Ser. No. 10/327,720 filed by the inventor named in this document on Nov. 20, 2002, and for which the U.S. Patent Office has issued a notice of allowability.

The apparatus disclosed and claimed in this document includes a holder for a non-folding tool such as a variably positionable sheath allowing removal of a fixed-blade knife, also known as an open knife, from, and insertion of a fixed-blade knife into, the sheath using only one hand. The term "fixed-blade" knife, as used in this document includes fixed blade, open blade, and unitary knives.

Fixed-blade knives generally include both a blade and a handle, but the handle of some knives may be little more than an extension of the heel of the blade. The blade generally includes a tip, two sides, a back or back spine, and at least one cutting edge. The handle generally surrounds the heel of the blade in a substantially fixed position relative to the handle between opposing sides of the fixed-blade. Fixed-blade knives tend to be heavy, use-specific, user-specific, and both difficult and dangerous to carry and use unsheathed.

Knife designers and manufacturers of fixed knives have focused on the design and methods of manufacturing a sheath to provide safe, silent, rapid control storage, deployment and use of a fixed-blade knife using a single hand. Those who have considered sheaths have not advanced the teaching in the art.

For example, most sheaths for fixed-blade knives have proven to be expensive, unsafe, and unreliable for single-handed deployment and sheathing. Sheaths for fixed-blade knives have remained largely unchanged for generations, still tending to be made of leather, and designed more for appearance than for safe, silent, rapid control, storage, deployment and use of a fixed-blade knife.

Safety of the user of a fixed blade knife is of considerable concern among those who use knives. Many uses, particularly in military and law enforcement environments, require substantially silent removal of a knife from a sheath, as well as silent replacement of the fixed blade knife. Sheaths not designed for safe, silent, rapid deployment and uses of a fixed-blade knife are a major limitation in the market.

Perhaps because makers and manufacturers of knives have tended to focus on knife and handle design, rather than on sheath design, the knife industry as a whole seems to have concluded that solutions for single-handled draw of a fixed-blade knife cannot be improved. Little effort has been devoted to designing a sheath, and accompanying mechanisms associated with a sheath, to solve the problems associated with achieving single-handed removal of a fixed-blade knife from a sheath, reinsertion, and storage.

The limitations of the current state of the art become evident on using a fixed-blade knife using one hand. Current sheaths fail to assist a single-handed user in grasping, storing or holding the fixed-blade knife blade when not in use.

Therefore, a previously unaddressed need exists in the industry for a new and useful variably positionable holder for a non-folding tool, such as a sheath for a fixed-blade knife, that provides a user safe, silent, rapid control storage, deployment and use of a fixed-blade knife (collectively, "sheathing") with one hand.

SUMMARY

The holder for a non-folding tool described and claimed in this document includes a sheath, a tension membrane positionable in the sheath for slidably securing the tool in the sheath, a blade guard detachably insertable into one end of the sheath, a thumb break member removably connectable to the blade guard, and a variably positionable mounting assembly engageable with the sheath and a user of the holder (collectively, "components").

It will become apparent to one skilled in the art that the claimed subject matter as a whole, including the structure of the apparatus, and the cooperation of the components of the apparatus, combine to result in a number of unexpected advantages and utilities. The structure and co-operation of structure of the holder for a non-folding tool will become apparent to those skilled in the art when read in conjunction with the following description, drawing figures, and appended claims.

The foregoing has outlined broadly the more important features of the invention to better understand the detailed description that follows, and to better understand the contributions to the art. The holder for a non-folding tool is not limited in application to the details of construction, and to the arrangements of the components, provided in the following description or drawing figures, but is capable of other embodiments, and of being practiced and carried out in various ways. The phraseology and terminology employed in this disclosure are for purpose of description, and therefore should not be regarded as limiting. As those skilled in the art will appreciate, the conception on which this disclosure is based readily may be used as a basis for designing other structures, methods, and systems. The claims, therefore, include equivalent constructions. Further, the abstract associated with this disclosure is intended neither to define the holder for a non-folding tool, which is measured by the claims, nor intended to limit the scope of the claims. The novel features of the holder for a non-folding tool are best understood from the accompanying drawing, considered in connection with the accompanying description of the drawing, in which similar reference characters refer to similar parts, and in which:

DETAILED DESCRIPTION

Figure 1:
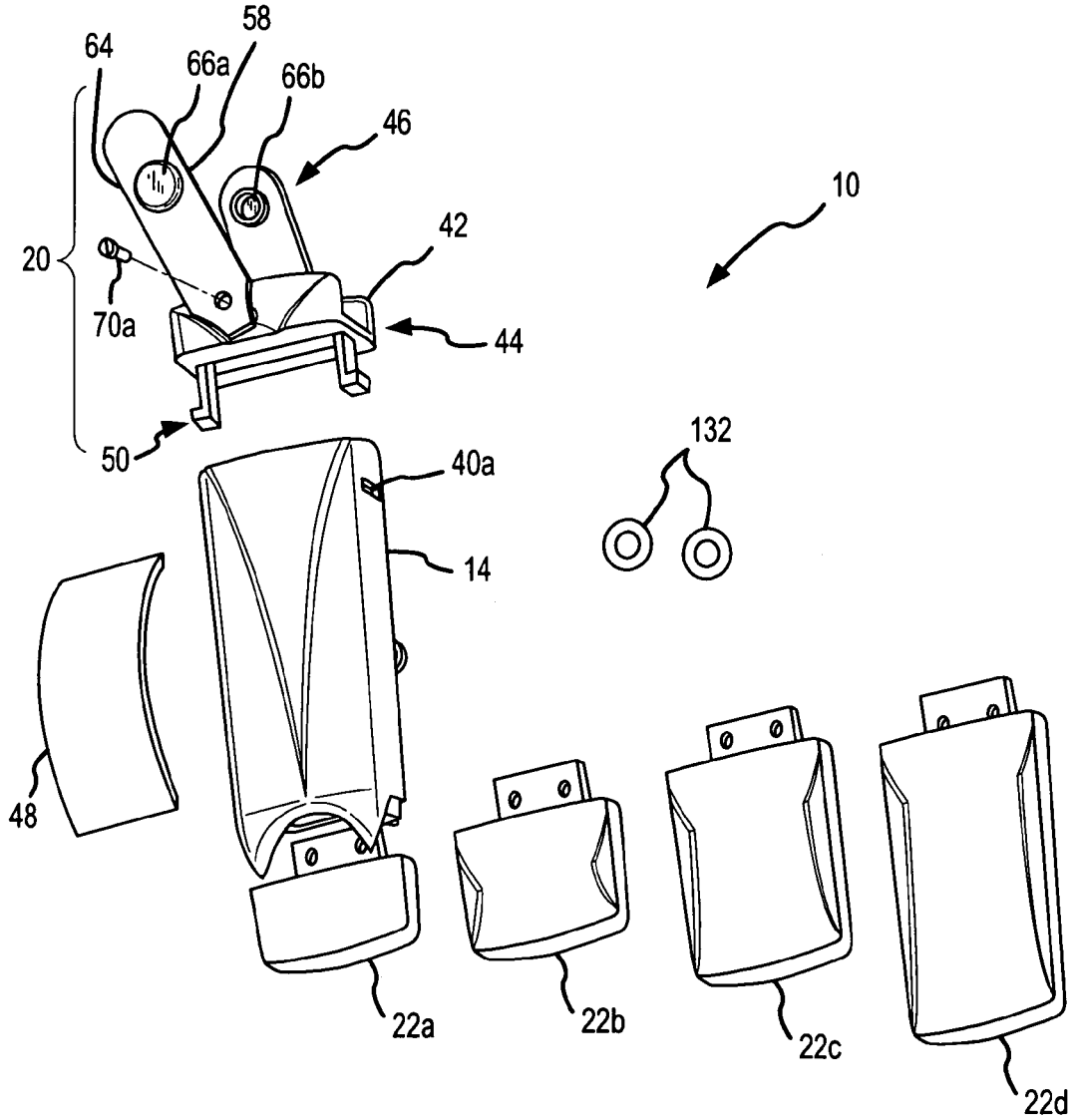
FIG. 1 of the drawing is a perspective front view of the components of the holder for a non-folding tool.

As shown in FIGS. 1-8, a holder for a non-folding tool that in a variety of embodiments serves as a variably positionable sheath 10 for a fixed-blade knife 12 is provided that, in the broadest context, includes a first case 14 formed with a duct 16 into which a blade 18 of fixed-blade of a knife 12 is removably positionable, a deployment control unit 20 that is detachably insertable in first case 14, a second case 22 that is formed with a cavity 24, the second case 22 being removably connectable to first case 14, and means 26 for variably positioning sheath 10 in relation to a user 28.

With regard to FIGS. 1-8, to the extent that subscripts to the numerical designations include the lower case letter "n," as in "a-n," the letter "n" is intended to express a number of repetitions of the item designated by that numerical reference.

Figure 2:
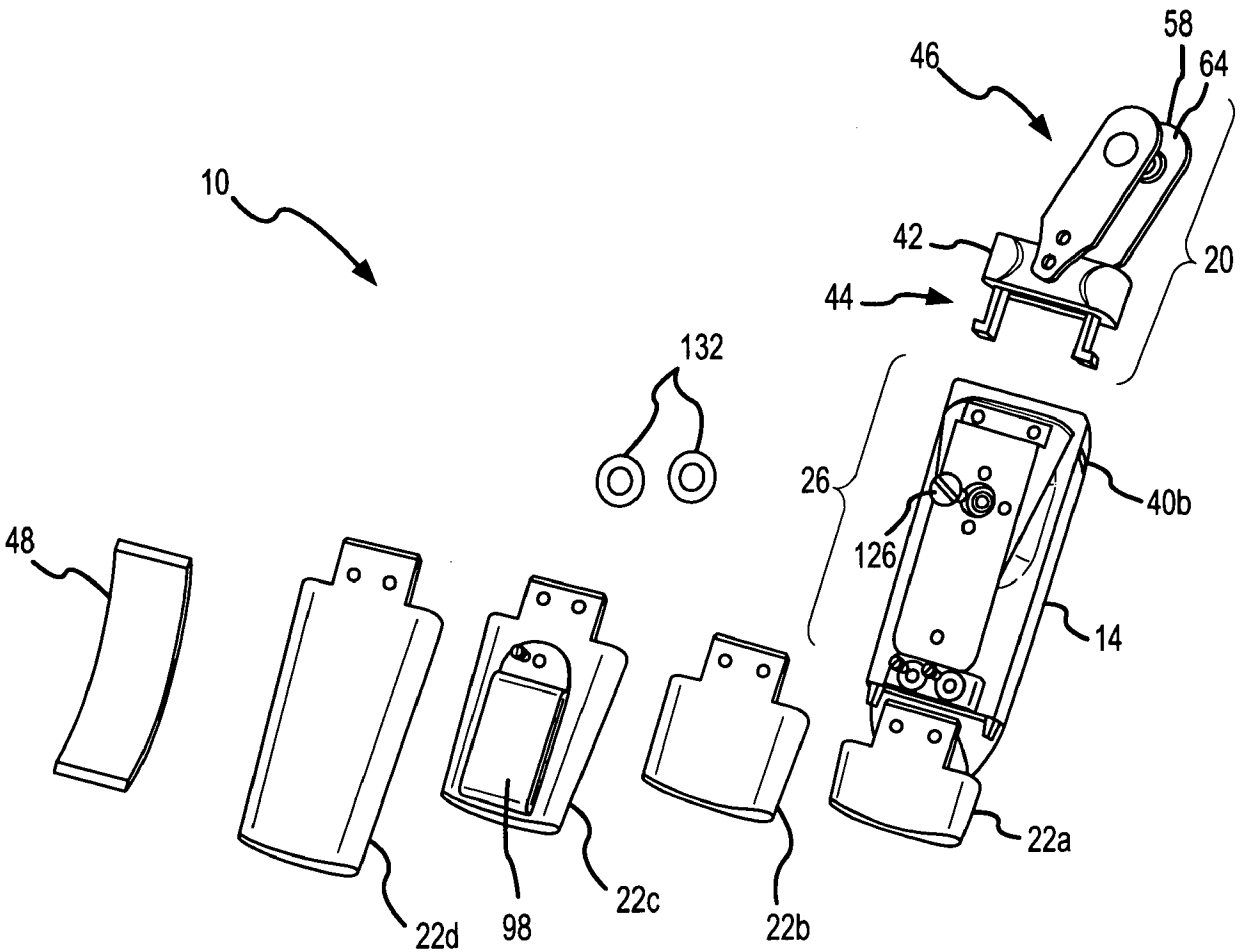
FIG. 2 is a perspective rear view of the components of the holder for a non-folding tool.
Figure 2A:
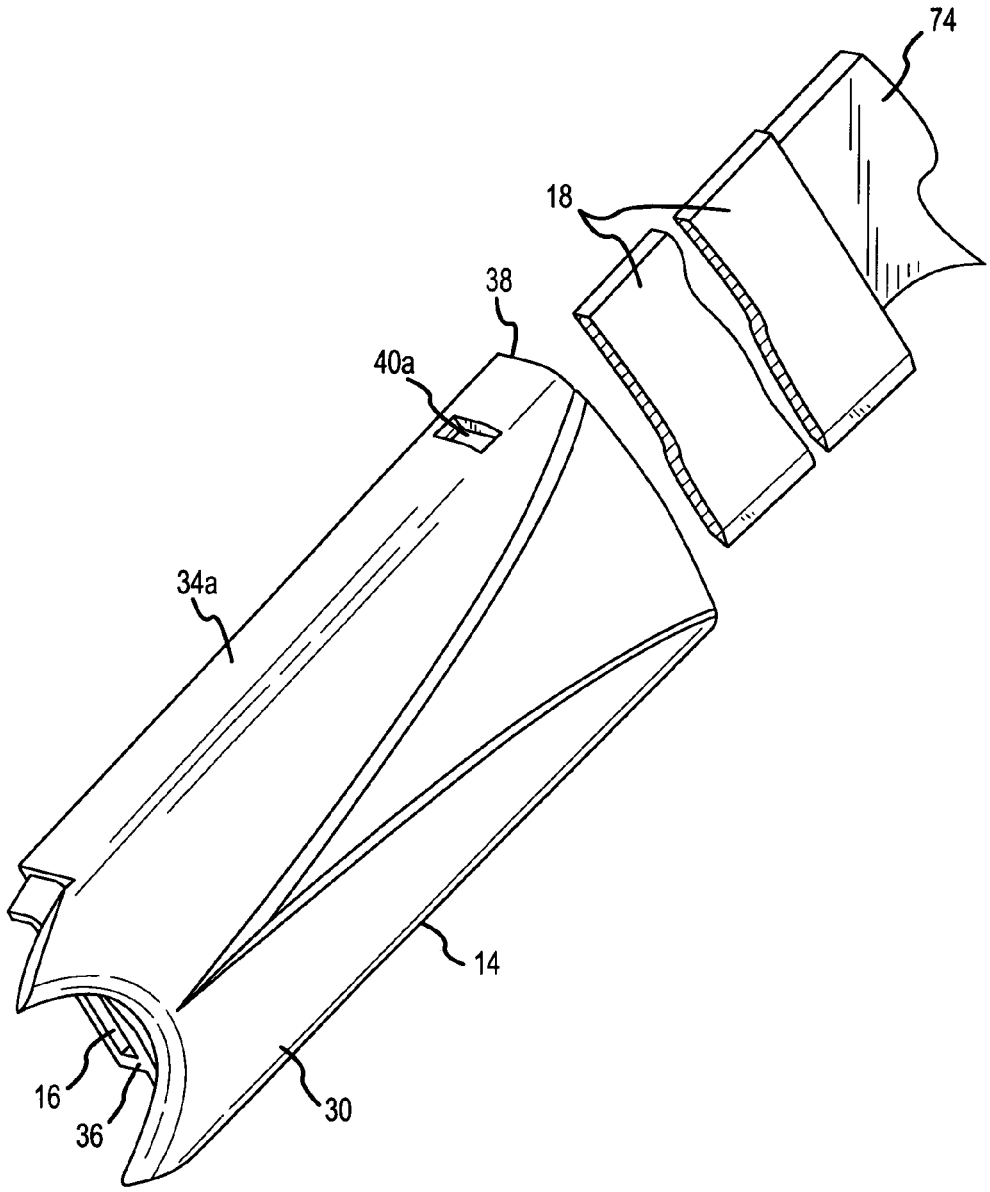
FIG. 2A is a front perspective view of the first case.
Figure 2B:
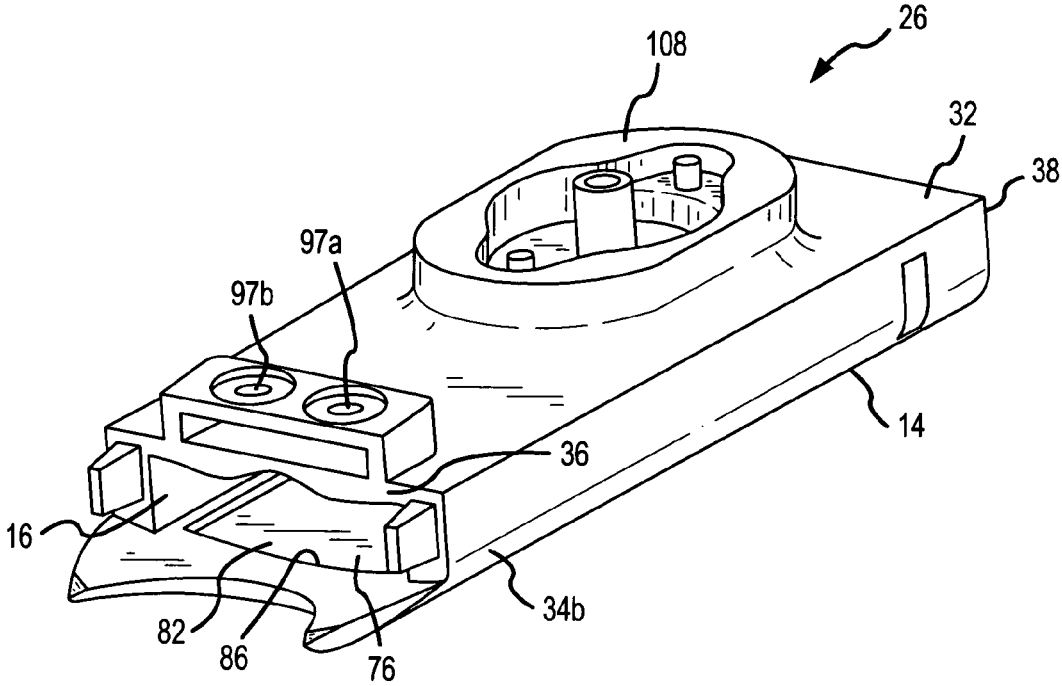
FIG. 2B is a rear perspective view of the first case.
Figure 2C:
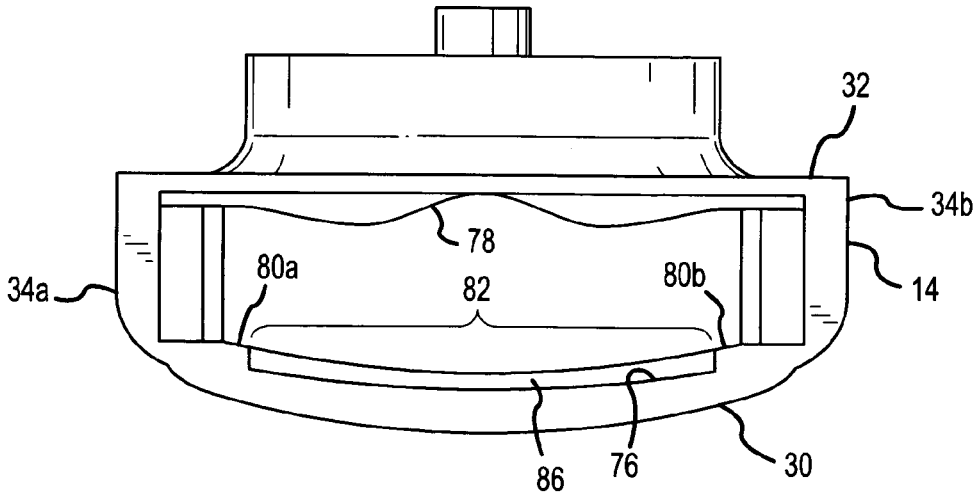
FIG. 2C is an end view of the first case.
Figure 2D:
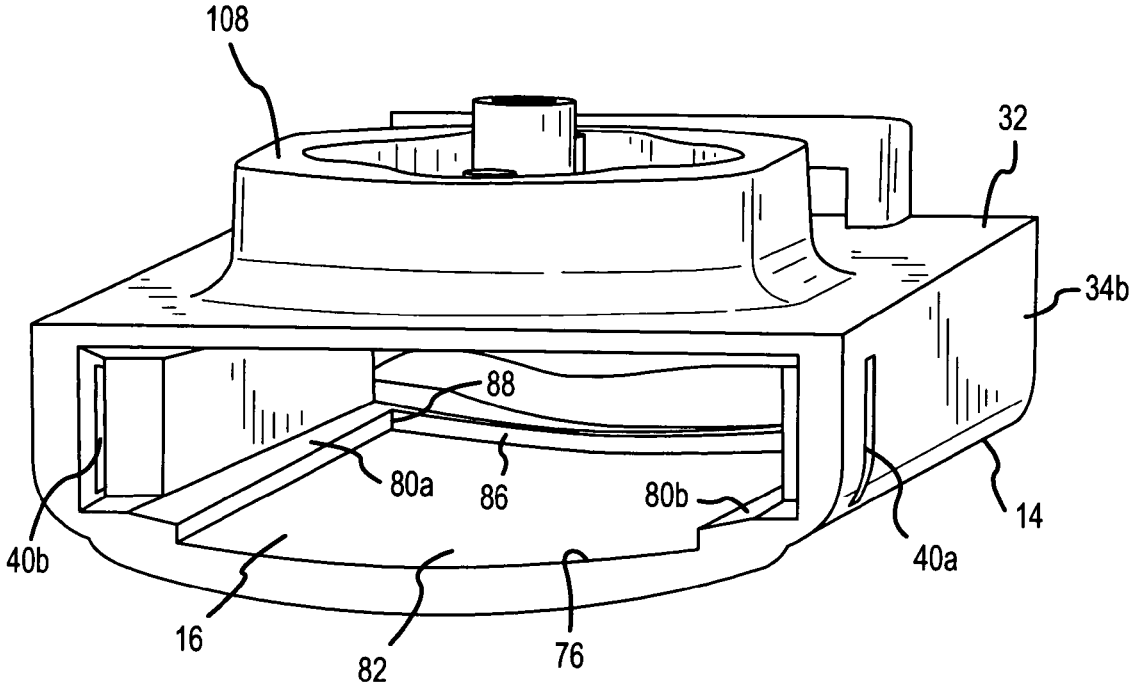
FIG. 2D is an end perspective view of the first case.

More specifically, as shown by cross-reference between FIGS. 1-2D, first case 14 of sheath 10 is formed with a first face 30, a second face 32, opposing sides 34*a,b* between first face 30 and second face 32, a distal end 36, and a proximal end 38. As also shown by cross-reference between FIGS. 1-2D, first case 14 is formed with at least one duct 16. In the embodiment illustrated in FIGS. 2B-2D, and perhaps best in FIG. 2C, duct 16 is shown as tapered between proximal end 38 and distal end 36 of sheath 10, the narrower portion of the tapered duct 16 being adjacent distal end 36. As shown perhaps best by cross-reference between FIGS. 1, 2, and 2A-2B, opposing slots 40*a,b* are formed in sheath 10. In the embodiment illustrated in FIGS. 1, 2, and 2A-2B, slots 40*a,b* are formed in opposing sides 34*a,b* adjacent proximal end 38 of sheath 10. As shown, slots 40*a,b* provide a mechanical advantage for detachably inserting a blade guard 42, described in more operational detail below, into proximal end 38 of sheath 10.

In the embodiment illustrated by cross-reference between FIGS. 1, 2, 3B-3D, and 8, deployment control unit 20 is shown. As shown, deployment control unit 20 includes means 44 for protecting a user during deployment from, and insertion into, first case 14, means 46 for releasing fixed-blade knife 12 for deployment from first case 14, a tension membrane 48 removably positionable in first case 14 for slidably engaging blade 18 of fixed-blade knife 12 in first case 14, and means 50 for disposing protecting means 44 in first case 14.

Figure 3A:
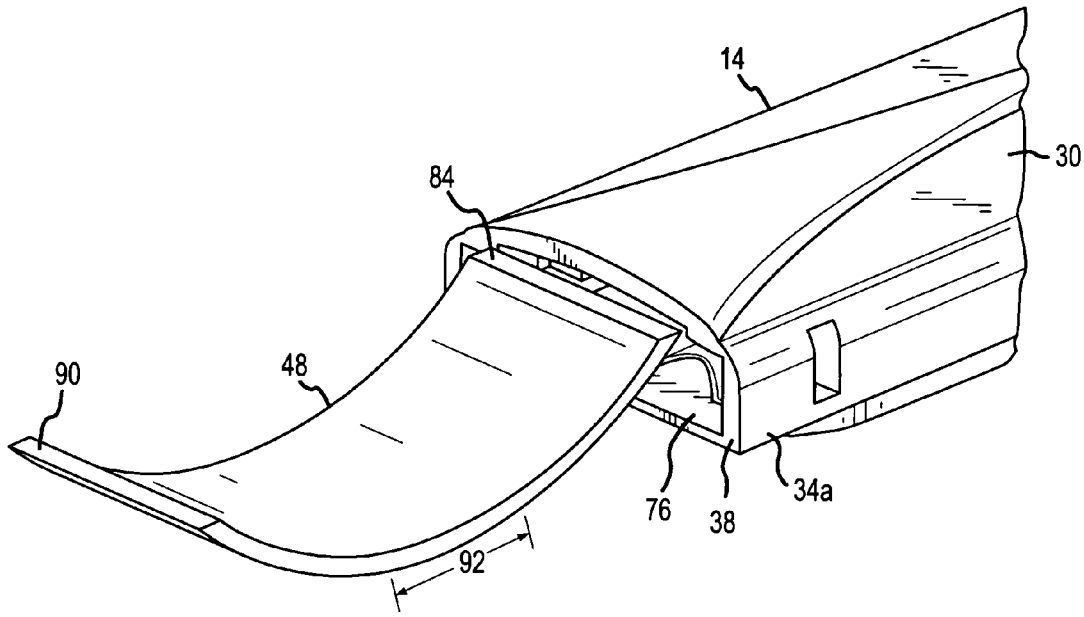
FIG. 3A is a perspective rear view of the tension membrane before insertion into the first case.
Figure 3B:
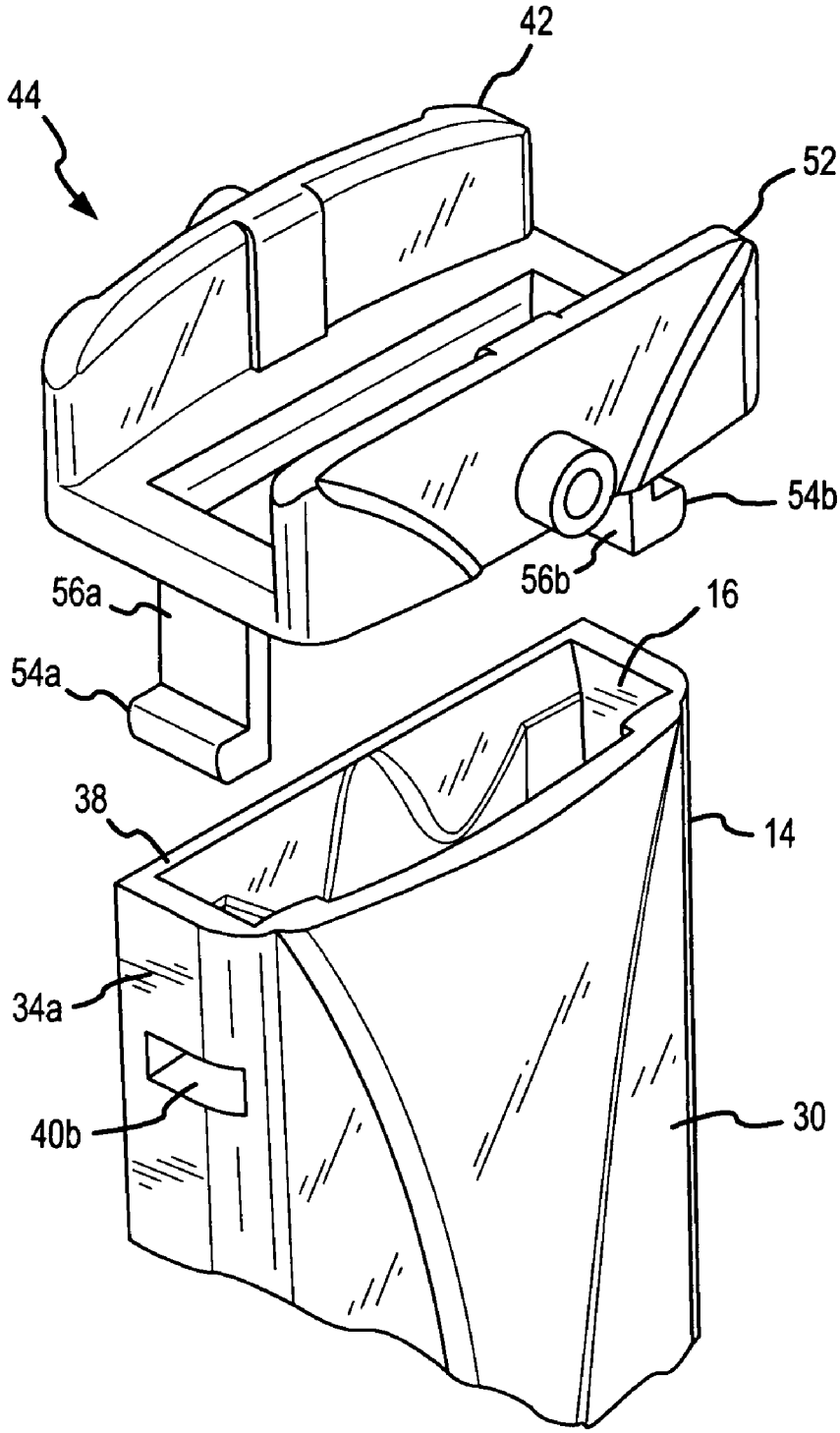
FIG. 3B is a perspective rear view of the blade guard before insertion into the first case.

In the embodiment illustrated in FIGS. 1-2, 3B, and 3D, and perhaps best shown in FIG. 3B, means 44 for protecting a user during deployment from, and insertion into, first case 14 includes blade guard 42. As shown, blade guard 42 includes means 50 for disposing protecting means 44 in first case 14. Means 50 includes a hollow frame 52 formed with opposing shoes 54*a,b* removably mountable in opposing slots 40*a,b*. The mechanical advantages associated with mounting opposing shoes 54*a,b* on hollow frame 52 include ease of mounting and decoupling blade guard 42 from proximal end 38 of sheath 10, while providing a firm apparatus for protecting user 28 from cuts and slashes that might otherwise occur during insertion in sheath 10, or removal from sheath 10, of an exposed, open blade 18. Blade guard 42 is an extra defense to such injuries. Legs 56*a,b* are flexible, which provides the mechanical advantage of allowing a snap fit means for removably mounting opposing shoes 54*a,b* in opposing slots 40*a,b*.

Figure 3C:
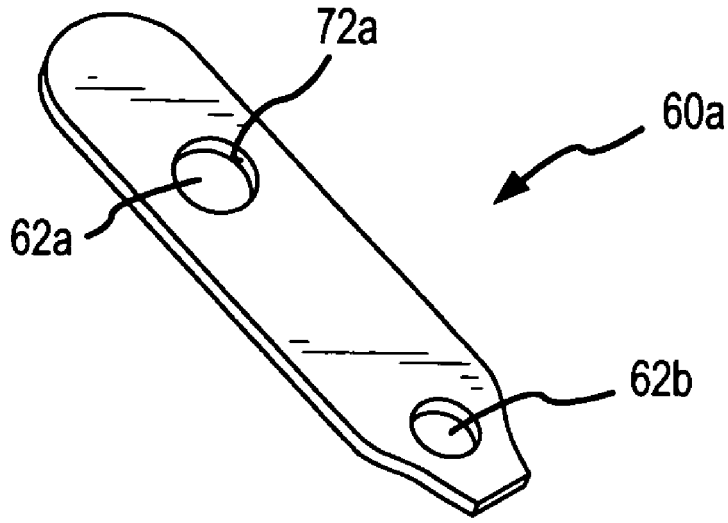
FIG. 3C is a perspective view of a first blade that comprises a thumb break.
Figure 3D:
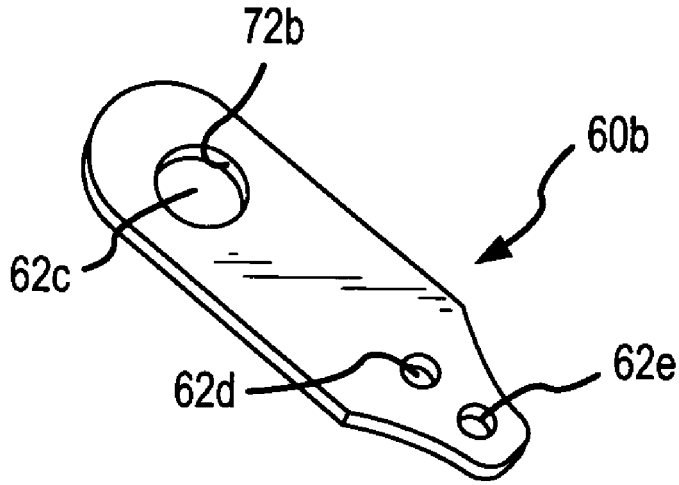
FIG. 3D is a perspective view of a second blade that comprises a thumb break.
Figure 8:
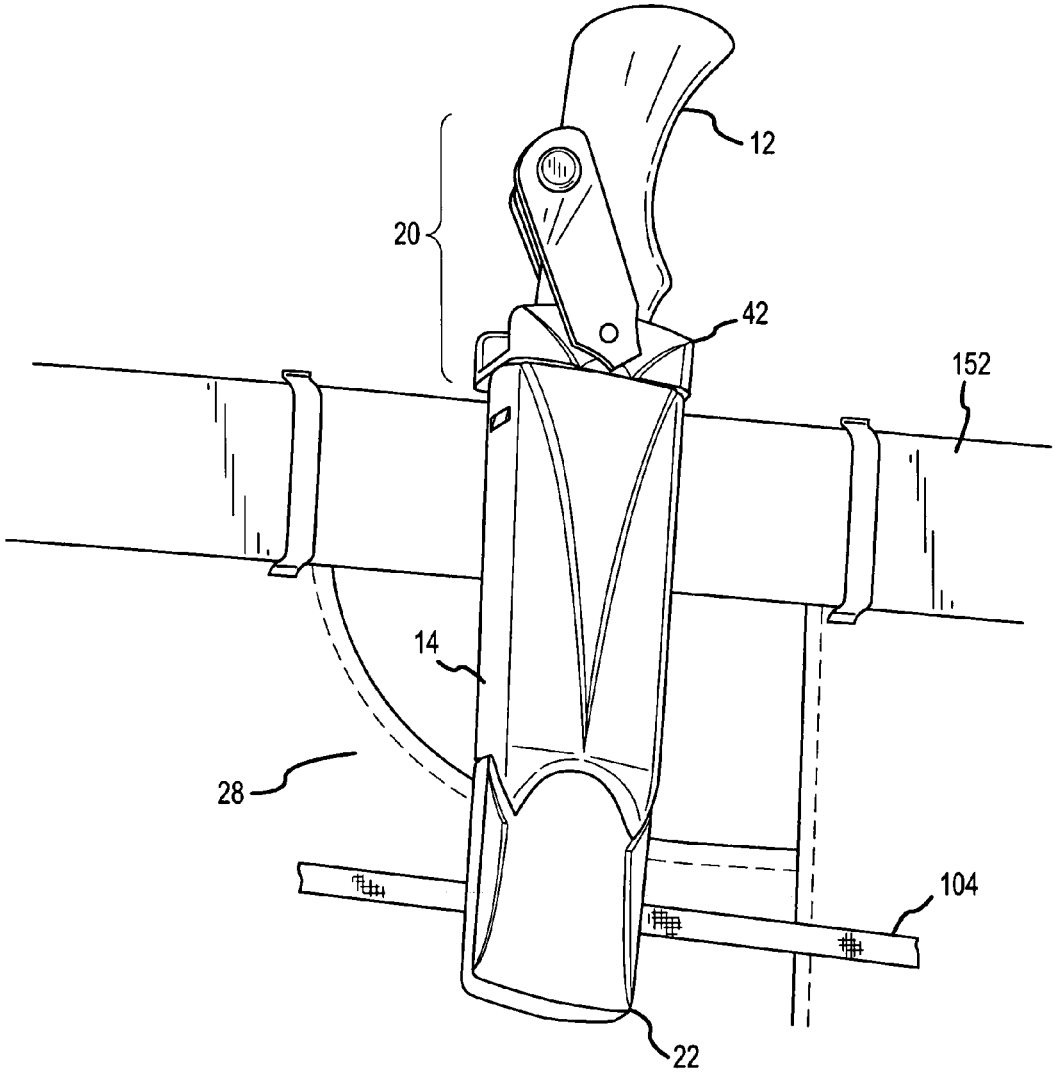
FIG. 8 is a perspective view of the holder for a non-folding tool attached to a user.

In the embodiment illustrated by cross-reference between FIGS. 1-2, 3C-3D, and 8, deployment control unit 20 also includes means 46 for releasing fixed-blade knife 12 for deployment from first case 14. In the embodiment illustrated in FIGS. 1-2, 3C-3D, and 8, means 46 for releasing fixed-blade knife 12 for deployment from first case 14 includes a thumb break member 58. Thumb break member 58 is removably connectable to blade guard 42. As shown, thumb break member 58 includes opposing plates 60*a,b*, as perhaps best shown by cross-reference between FIGS. 3C and 3D, formed with at least one opening 62*a-n*. Thumb break member 58 also includes a first connector 64, shown perhaps best by cross-reference between FIGS. 1 and 2, consisting of a plurality of snap-apart components 66*a-n*. First connector 64 is insertable into openings 62*a* and 62*c*, as shown in FIG. 3C, and is compressibly disconnectable from opposing plates 60*a,b*. Thus, first connector 64 is selected from the group of connectors consisting of snaps, snap-apart connectors, adjustable rivets, breakable releases, and non-breakable releases. Although FIG. 8 shows thumb break member 58 attached adjacent to upper edge 68 of hollow frame 52, thumb break member 58 may be located in any number of other positions, and although opposing plates 60*a,b* are shown connectable to hollow frame 52 using one or more screws 70*a-n*, other fasteners may be used, including, for example, threaded and unthreaded fasteners. In the embodiment shown in FIGS. 1-2, the mechanism for separating opposing plates 60*a,b* when user 28 desires to remove fixed-blade knife 12 from sheath 10 is first connector 64, which, as shown, is compressibly disconnectable, but the mechanism for performing that function may be any of a variety of mechanisms. One such alternative mechanism is a removable rubber grommet having an incised encircling groove (not shown) that mates with inner edges 72*a-n* of openings 62*a-n*. A compressibly disconnectable first connector 64 is merely exemplary of the types of mechanism that may be use. In operation of first connector 64 in the embodiment described above, user 28 may use a thumb of user's hand to strike thumb break member 58 to snap apart opposing plates 60*a,b*, thus providing access to handle 74 of fixed-blade knife 12. Thumb break member 58 also provides the mechanical advantage of acting as a safety by precluding inadvertent release of fixed-blade knife 12 from sheath 10 by securing handle 74 in sheath 10. In the embodiment shown in FIG. 3D, opposing plate 60*a* is shown with two openings 62*d,e*. Openings 62*d,e* are provided to allow adjustment of the length of protrusion of opposing plate 60*b* in relationship to the upper edge 68 of hollow frame 52.

In the embodiment illustrated by cross-reference between FIGS. 1, 2, and 3A, deployment control unit 20 also includes tension membrane 48 removably positionable in first case 14 for slidably engaging blade 18 of fixed-blade knife 12 in duct 16 of first case 14. As shown also by cross-reference between FIGS. 2B-2D and 3A, sheath 10 also is formed with an inner first surface 76, an inner second surface 78, and opposing ledges 80*a,b*. Tension membrane 48 is configured from a flexible material into a bow-shaped member dimensioned for mounting on inner first surface 76 of first case 14 and in the trough 82 formed on inner first surface 76 between opposing ledges 80*a,b*. As shown, opposing ledges 80*a,b* taper from a wider dimension adjacent proximal end 38 of sheath 10 to a narrower dimension adjacent distal end 36 of sheath 10. Leading end 84 of tension membrane 48, when inserted, is in contact with a back-stop 86 as shown perhaps best in FIG. 2D at the forward end 88 of trough 82. Following end 90 of tension membrane 48 is in contact with inner first surface 76 adjacent proximal end 38 of sheath 10. An arched or dome portion 92 of tension membrane 48 is in contact with inner second surface 78 of sheath 10. The mechanical advantage provided by tension membrane 48 is a removable, flexible tongue that applies pressure on blade 18 to hold blade 18 within sheath 10 until user 28 elects to deploy fixed-blade knife 12 from sheath 10.

Figure 4A:
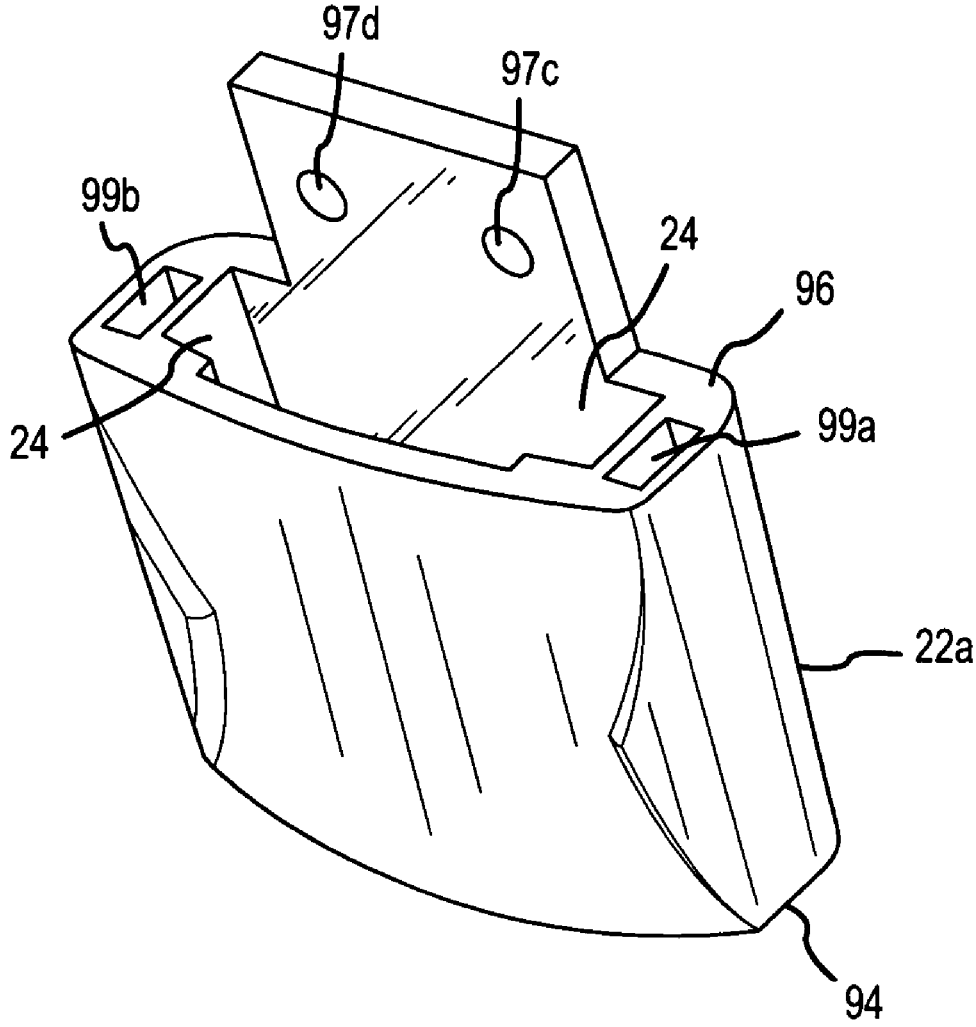
FIG. 4A is a perspective view of one iteration of the second case.
Figure 4B:
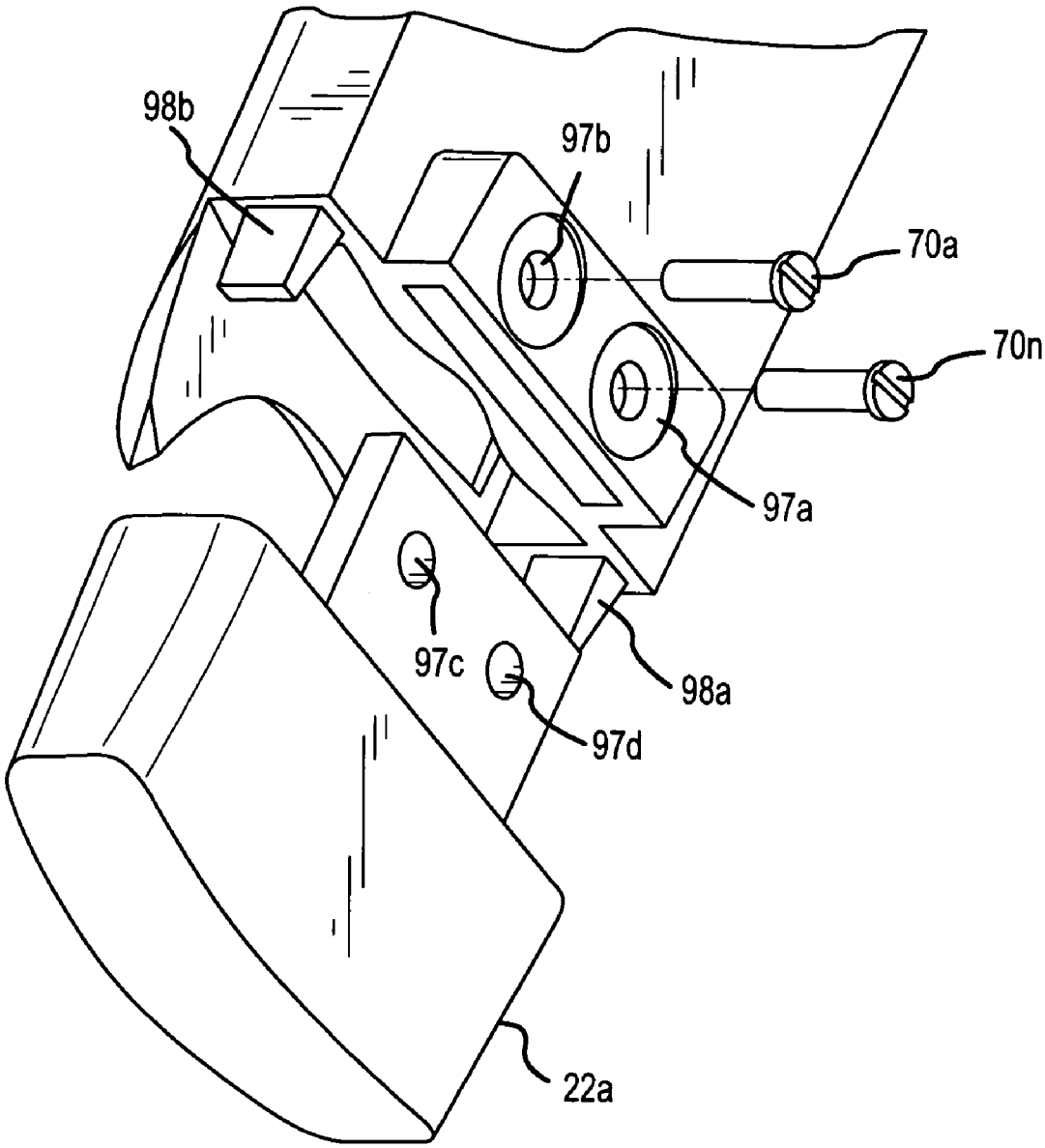
FIG. 4B is a perspective view of the second case before attachment to the first case.
Figure 5A:
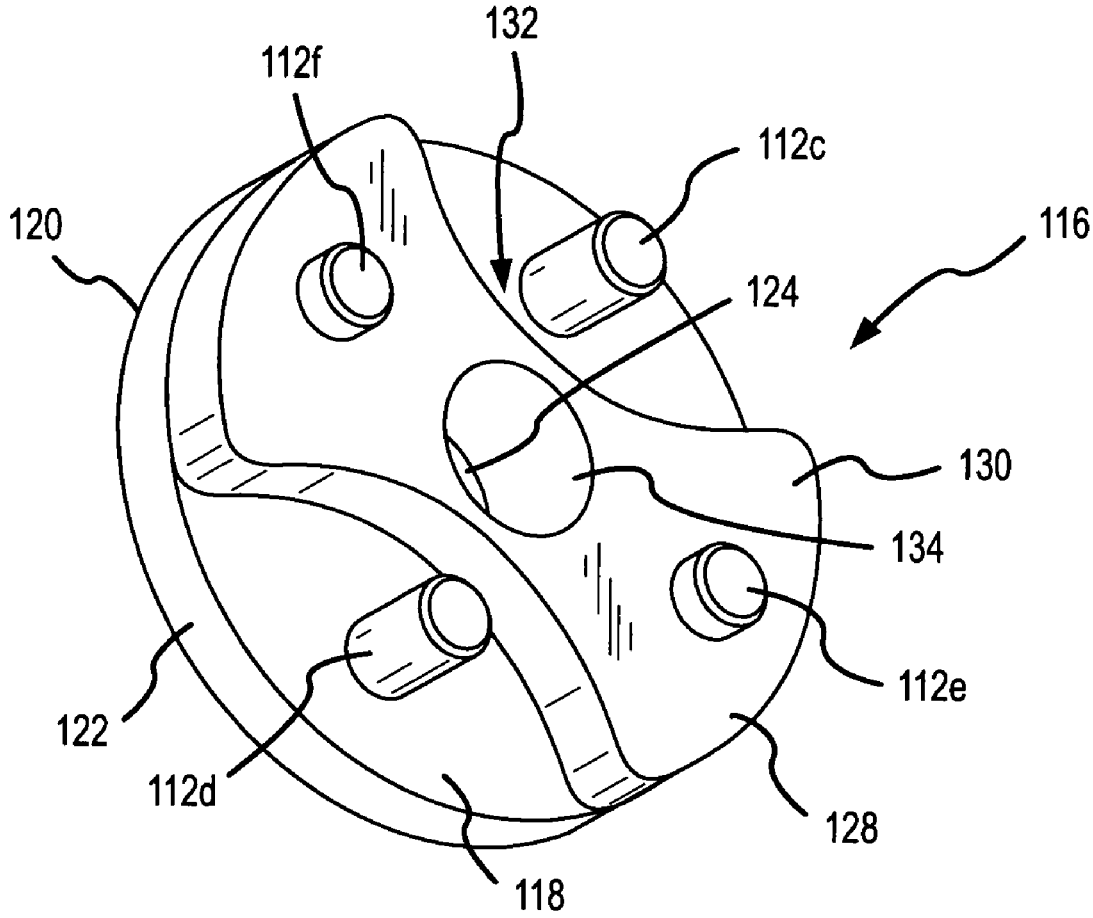
FIG. 5A is a perspective view of a disk.
Figure 5B:
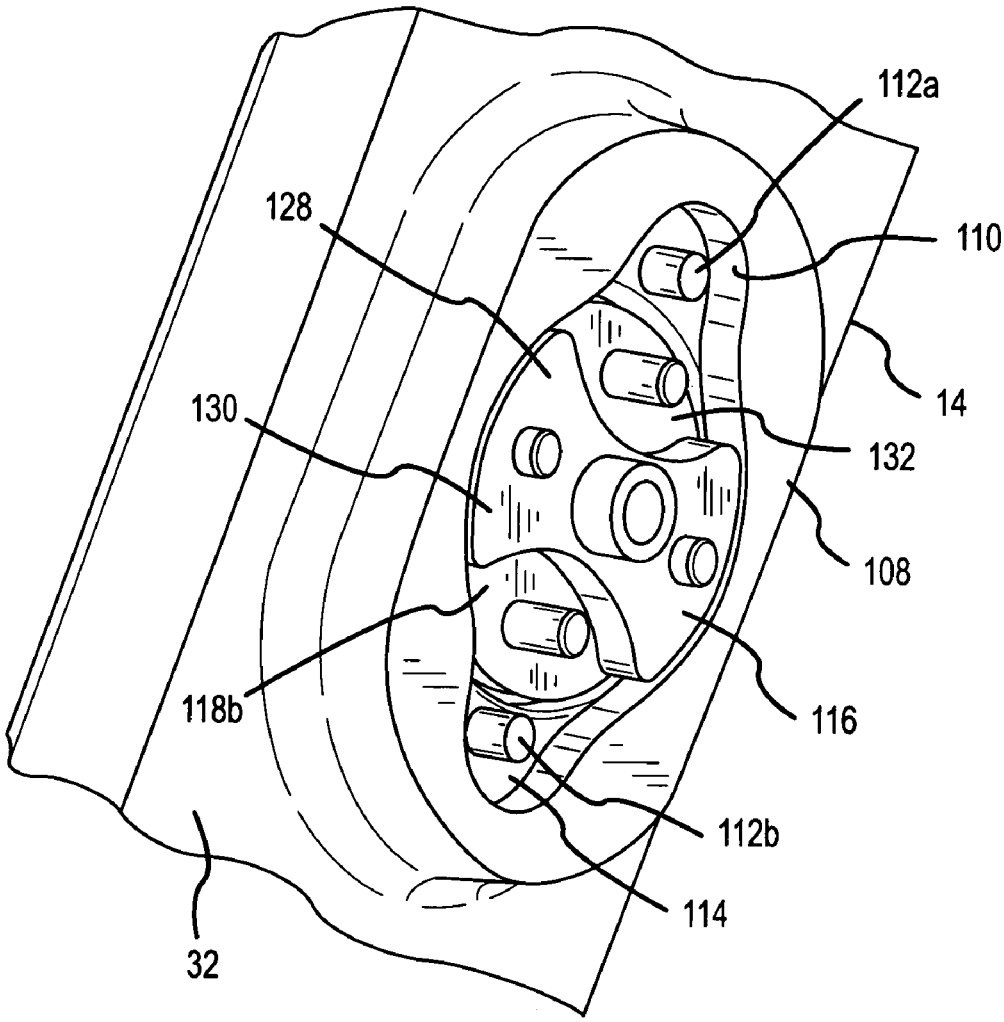
FIG. 5B is a perspective view of the tub with the disk of FIG. 5A inserted in the tub.
Figure 5C:
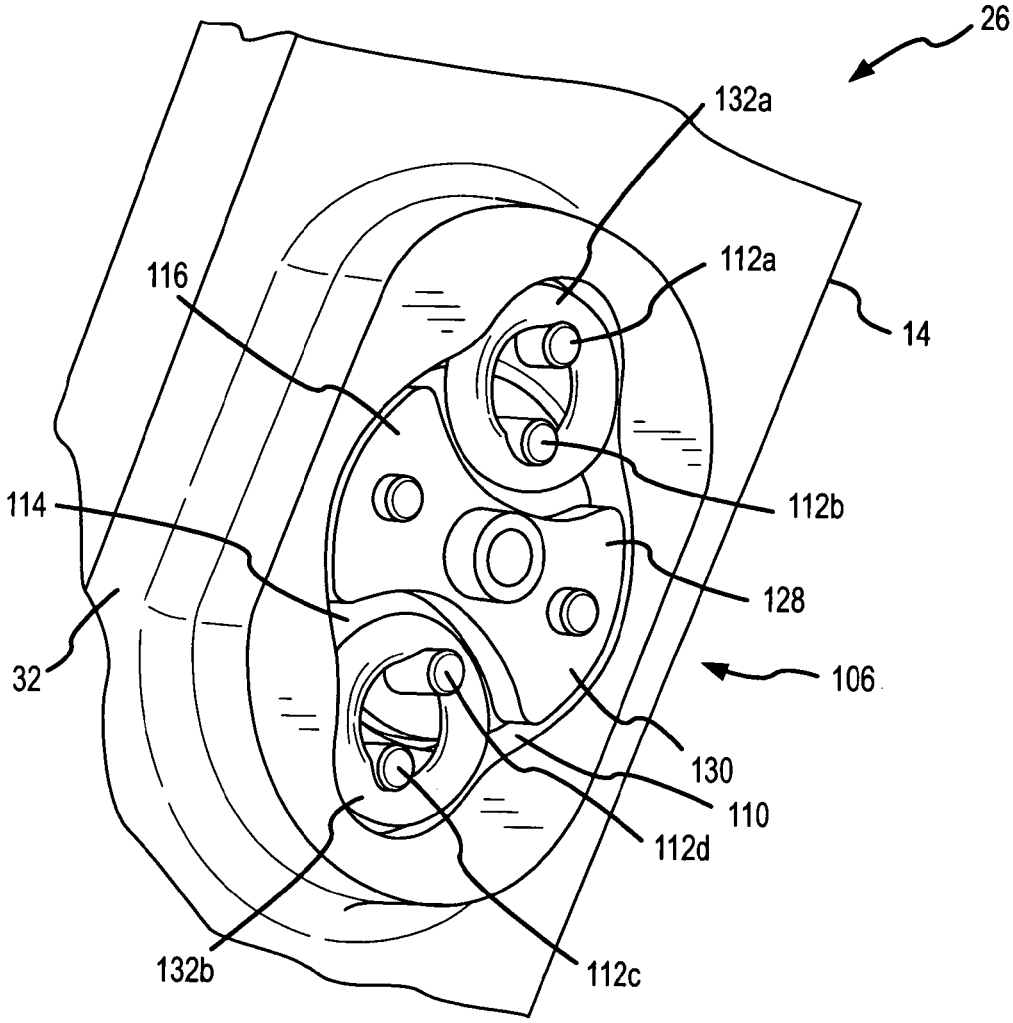
FIG. 5C is a perspective view of the tub, disk, and O-rings mounted.
Figure 5D:
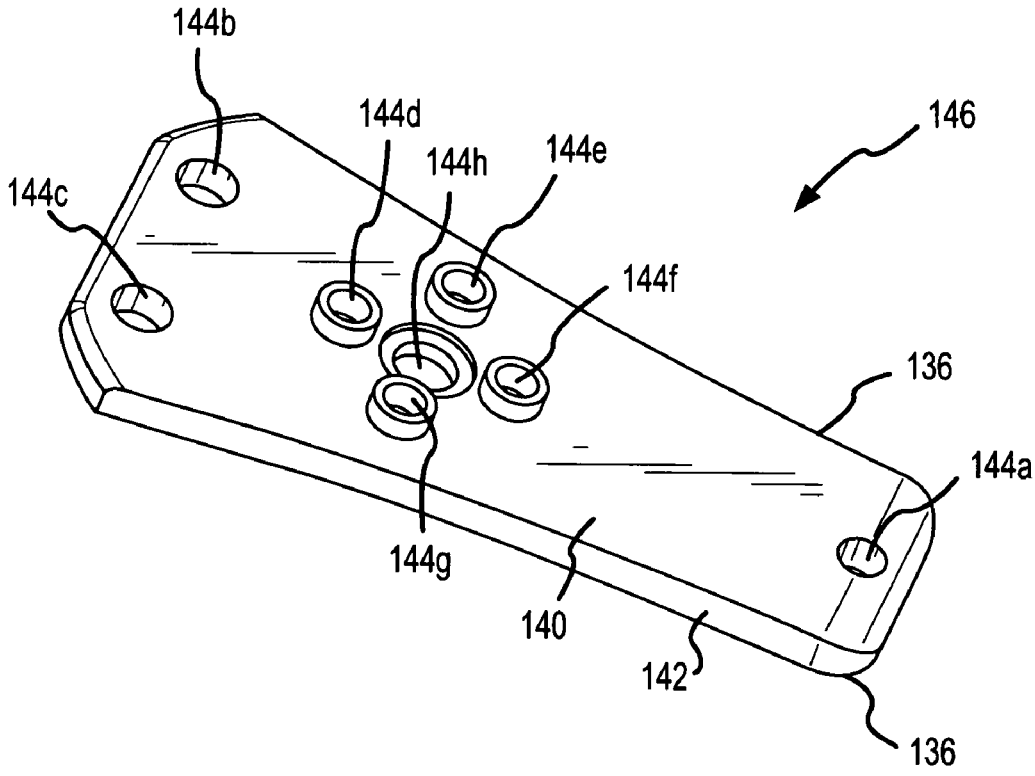
FIG. 5D is a perspective view of a leverage plate.
Figure 5E:
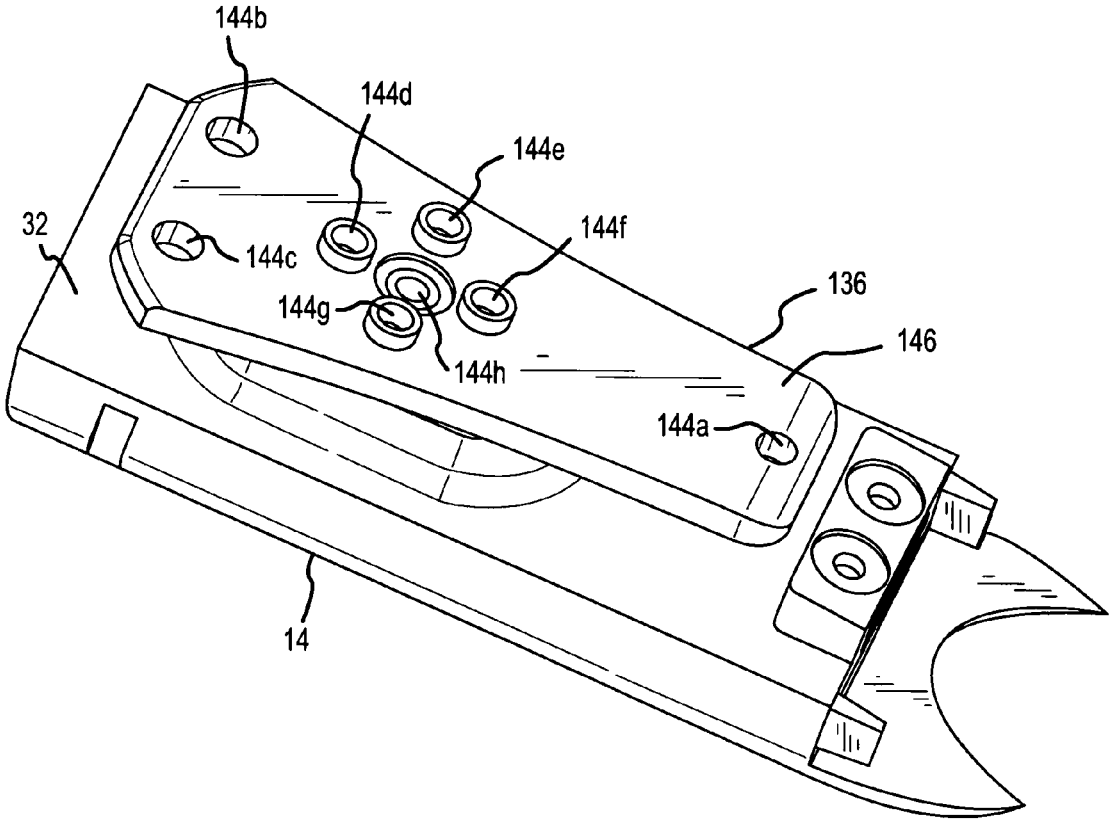
FIG. 5E is a perspective view of a leverage plate positioned for mounting on the tub and disk.
Figure 6:
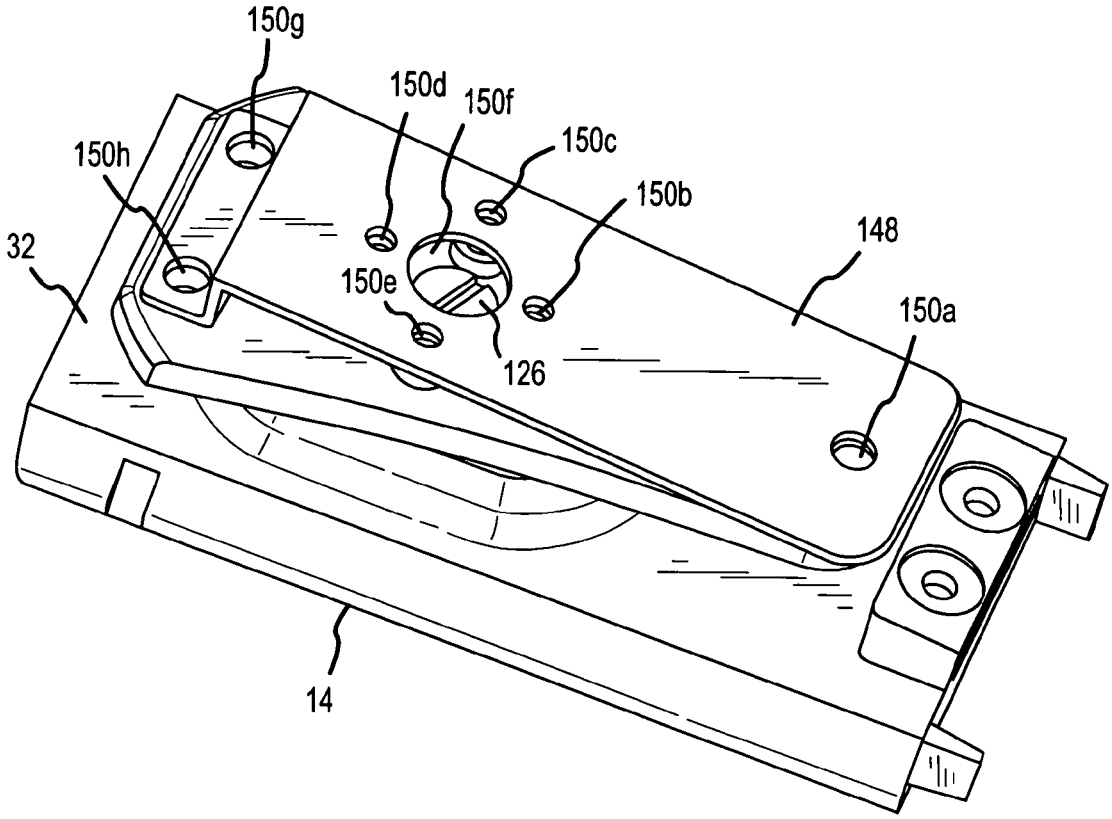
FIG. 6 is a perspective view of a belt clip positioned for mounting on the leverage plate.

In the embodiment illustrated by cross-reference between FIGS. 1-2, 4A-4B, and 7-8, sheath 10 also includes a second case 22. Second case 22 is connectable to first case 14 for adjusting sheath 10 to accommodate variably sized non-folding tools such as fixed-blade knife 12. Fixed-blade knife 12 may be manufactured in a wide variety of lengths and widths. Second case 22 is therefore provided in a similar wide variety of lengths and widths. Indeed, second case 22 is provided in a number of varying dimensions that may be mounted on first case 14 to extend sheath 10 to any length or width necessary to accommodate blade 18 of fixed-blade knife 12. Second case 22 is formed with a lower end 94, an upper end 96, and cavity 24 that is closed adjacent lower end 94 of second case 22 to prevent user injury by the tip or edge of blade 18. In the embodiment shown by cross-reference between FIGS. 1-2, 4A-4B, and 7-8, second case 22 is connectable to first case 14 by use of one or more fasteners 70*a-n* insertable into one or more bores 97*a-n* as shown in FIG. 4B. Opposing wedges 98*a,b* formed in distal end 36 of first case 14 are slidably insertable into chambers 99*a,b* as shown in FIGS. 4A-4B for added rigidity and strength of assembly.

Figure 7:
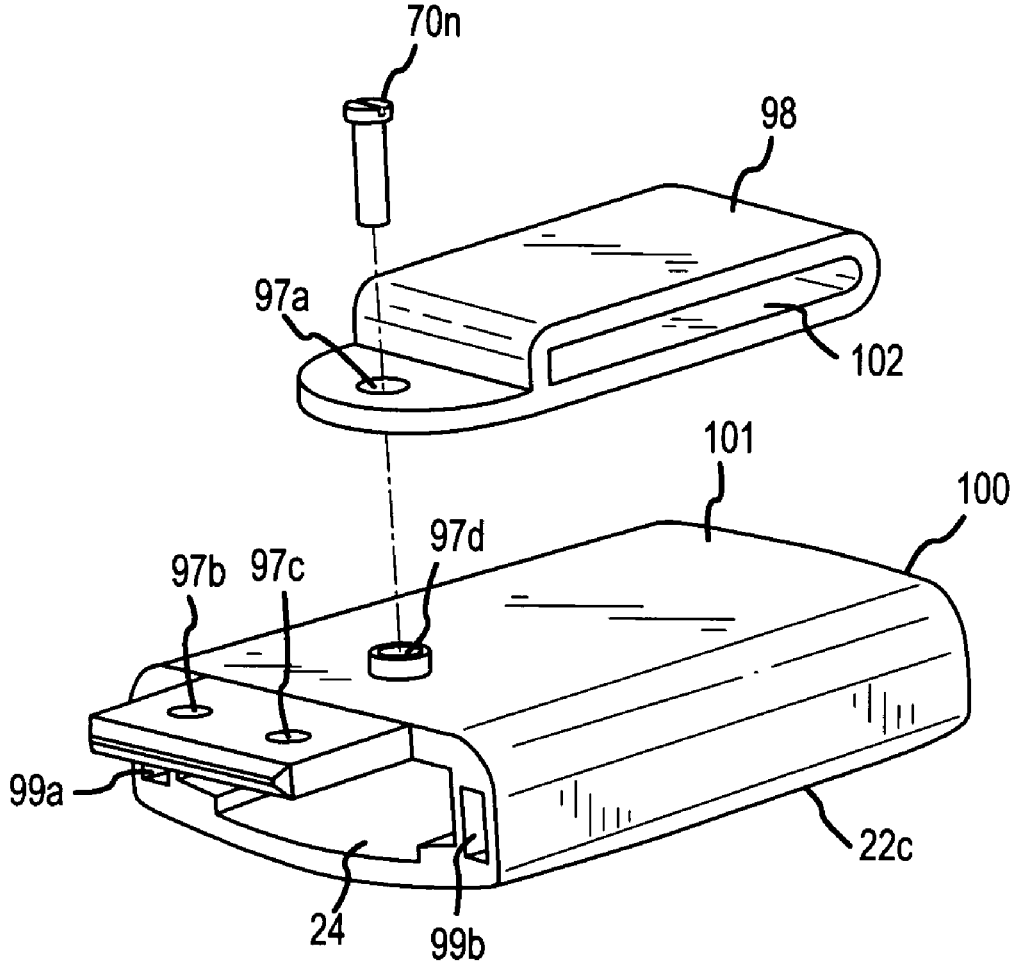
FIG. 7 is an exploded perspective view of a leg strap swivel clip mountable on the second case.

A leg strap swivel clip 100, as shown by cross-reference between FIGS. 2 and 7, is provided. Leg strap swivel clip 100 is mountable on the back surface 101 of second case 22 as shown best in FIG. 7. Leg strap swivel clip 100 is rotatable around fastener 70*a-n* for maximum mobility of user 28. A sleeve 102 is provided in leg strap swivel clip 98, and a strap 104 as shown in FIG. 8 may be inserted through sleeve 102 and secured to a user's thigh to prevent sheath 10 from movement when user 28 is conducting an activity using fixed-blade knife 12 in connection with sheath 10, and for enhancing silent removal of fixed-blade knife 12 from sheath 10.

As also shown by cross-reference between FIGS. 2 and 5A-5E, sheath 10 includes means 26 for variably positioning sheath 10 in relation to a user 28. In the embodiment shown in FIGS. 5A-5D, means 26 includes a variably positionable mounting assembly 106 engageable with sheath 10 and user 28. Variably positionable mounting assembly 106 includes a tub 108. As shown, tub 108 is monolithically formed to extend from second face 32 of sheath 10. Tub 108 includes a first hole 110. At least one peg 112*a-n* is mounted on tub 108, extending at substantially a right angle from the inner surface 114 of tub 108. Also included in variably positionable mounting assembly 106, in the embodiment shown in FIGS. 5A-5D, is a disk 116. Disk 116 is removably and rotatably mountable in tub 108. Disk 116 is formed with an anterior side 118, a posterior side 120, and a wall 122 between anterior side 118 and posterior side 120. At least one peg 112*a-n* is mounted on anterior side 118 of disk 116 to extend substantially at a right angle from anterior side 118 of disk 116. A second hole 124 is formed substantially in the center of disk 116. Second hole 124 extends between anterior side 118 and posterior side 120 of disk 116 for insertion of a second connector 126 that is shown perhaps best in FIG. 6. Second connector 126 may be selected from a group of connectors consisting of threaded and unthreaded screws, bolts, nuts, and rivets. Second connector 126 is, however, but one mechanism for connecting disk 116 and tub 108. One such alternative mechanism may be a rubber rod having a plastic coating. In the embodiment shown in FIG. 5A, disk 116 also includes a substantially hourglass shaped body 128 having an upper surface 130. In the embodiment shown in FIGS. 5A-5C, body 128 is substantially hourglass in shape, but the shape is not a limitation of sheath 10. The substantially hourglass shape is but one shape that provides a space 132 adjacent at least one peg 112*a-n* for insertion of one or more O-rings 132*a-b* further described below. It has been proven, however, that the hourglass shape also provide the mechanical advantage of allowing greater rotation for the heavier, more massive tools such as a fixed-blade knife 12. Body 128 extends from anterior side 118 of disk 116. In the embodiment shown in FIG. 5A, body 128 is monolithically attached to anterior side 118 of disk 116. A third hole 134 is formed in body 128. Third hole 134 is coincident with a longitudinal axis through the centers of first hole 110 and second hole 124. At least one peg 112*e,f-n* is mounted on upper surface 130 of body 128 at a substantially right angle. The one or more O-rings 132*a-b* are demountably positionable on the at least one peg 112*a-n* of disk 116 and at least one peg 112*e,f* on tub 108.

Variably positionable mounting assembly 106 also includes a block 136 formed with an inner plane 138, an outer plane 140, a border 142, and a plurality of apertures 144*a-n* formed in block 136. Block 136 is used as a leverage plate 146. Plurality of apertures 144*a-n* of leverage plate 146 is positionable over pegs 112*a-n* of disk 116. Variably positionable mounting assembly 106 also includes a lap-over band 148. Lap-over band 148 is formed with one or more holes 150*a-n*. One or more holes 150*g,h* are engageable with leverage plate 146, and provide means for inserting one or more second connectors 126 (not shown to enhance drawing appearance) through the one or more holes 150*g,h* for attaching lap-over band 148 and leverage plate 146 to sheath 10. Lap-over band 148 is slidably engageable with, for example, a belt 152 of user 28 as shown in FIG. 8. In operation, the holder for a non-folding tool that in a variety of embodiments also serves as a variably positionable sheath 10 for a fixed-blade knife 12 is variably positionable in relationship to a user 28 who can manipulate variably positionable mounting assembly 106 with a single hand in a rotational manner. The one or more O-rings 132*a-n* provide flexible expansion and contraction to return sheath 10 to a desired position.

While materials used to construct sheath 10 and the components of sheath 10 are not a limitation on sheath 10, the material may be selected from the group of materials consisting of plastics, resins, nylons, Zytel®, Kevlar®, composite materials, as well as metal.

What is claimed is:

1. A holder for a non-folding tool, comprising:

a sheath formed with a first face, a second face, opposing sides between the first and second face, a distal end, and a proximal end;

a tension membrane positionable in the sheath for slidably securing the tool in the sheath;

a blade guard detachably insertable into one end of the sheath;

a thumb break member removably connectable to the blade guard; and a variable positionable mounting assembly comprising:

a tub monolithically extending from the second face of the sheath, wherein the tub is formed with a first hole and an inner surface and an outer surface, the tub including at least one peg extending at substantially a right angle from the inner surface of the tub, a disk removably and rotatably mountable in the tub, the disk formed with an anterior side, a posterior side, a center, and a wall therebetween, the disk including at least one peg extending substantially at a right angle from the anterior side of the disk, the disk including a second hole formed substantially in the center of the disk and extending between the anterior side and the posterior side of the disk for insertion of a second connector, and a substantially hourglass shaped body, having an upper surface, extending from the anterior side of the disk, formed with a third hole coincident with a longitudinal line through the centers of the first hole and the second hole.

2. A holder for a non-folding tool as recited in claim 1, wherein the sheath includes a first case formed with at least one tapered duct.

3. A holder for a non-folding tool as recited in claim 2, wherein opposing slots are formed in the sheath.

4. A holder for a non-folding tool as recited in claim 3, wherein the blade guard is a hollow frame formed with opposing flexible shoes removably mountable in the opposing slots.

5. A holder for a non-folding tool as recited in claim 2, wherein the sheath includes a second case connectable to the first case.

6. A holder for a non-folding tool as recited in claim 5, further comprising a leg strap swivel clip mountable on the second case.

7. A holder for a non-folding tool as recited in claim 1, wherein material for the holder is selected from the group of materials consisting of plastics, resins, nylons, composite materials, and metal.

8. A holder for a non-folding tool as recited in claim 1, wherein the tension membrane is formed substantially as a curved tongue having a dome segment between opposing ends of the curved tongue.

9. A holder for a non-folding tool as recited in claim 1, wherein the thumb break member includes opposing plates formed with at least one opening.

10. A holder for a non-folding tool as recited in claim 9, wherein the thumb break member includes a first connector insertable in the at least one opening for compressibly disconnecting the opposing plates.

11. A holder for a non-folding tool as recited in claim 10, wherein the first connector is selected from the group of connectors consisting of snaps, snap-apart connectors, adjustable rivets, breakable releases, and non-breakable releases.

12. A holder for a non-folding tool as recited in claim 1, wherein the second connector is selected from the group of connectors consisting of threaded and unthreaded screws, bolts, nuts, and rivets.

13. A holder for a non-folding tool as recited in claim 1, wherein the disk further comprises at least one peg extending from the upper surface of the substantially hourglass shaped body at a substantially right angle.

14. A holder for a non-folding tool as recited in claim 13, further comprising at least one O-ring demountably positionable on the at least one peg of the disk and the at least one peg on the tub.

15. A holder for a non-folding tool as recited in claim 1, further comprising a block formed with an inner plane, an outer plane, a border therebetween, and a plurality of apertures formed in the block.

16. A holder for a non-folding tool as recited in claim 15, wherein the variably positionable mounting assembly further comprises a lap-over band engageable with the block for mounting the holder on a user.

17. A variably positionable sheath for a fixed-blade knife comprising:

a first case formed with a duct;

a deployment control unit detachably insertable in the first case, wherein the deployment control unit includes means for protecting a user during deployment from, and insertion into, the first case, wherein the deployment control unit includes means for releasing the fixed-blade knife for deployment from the first case, wherein the disposing means is selected from the group of disposing means consisting of flexible shoes, rivets, screws, nuts, bolts, tongue-and-groove fittings, and nested couplings, wherein the deployment control unit includes a tension membrane removably positionable in the first case for slidably engaging the fixed-blade in the first case;

a second case formed with a cavity, wherein the second case is removably connectable to the first case;

a tub extending from a face of the first case;

a disk rotatably and removably mountable in the tub;

a plurality of pegs and a plurality of 0-rings engageable with the plurality of pegs; and a leverage plate formed with a plurality of apertures slidably engageable with the plurality of pegs.

18. A variably positionable sheath for a fixed-blade knife as recited in claim 17, further comprising a lap-over band engageable with the leverage plate.

* * * * *